US007717100B2

(12) United States Patent
Arima et al.

(10) Patent No.: US 7,717,100 B2
(45) Date of Patent: May 18, 2010

(54) BREATHER STRUCTURE OF ENGINE

(75) Inventors: Hisatoyo Arima, Himeji (JP); Ichiro Tanaka, Kakogawa (JP); Yuji Hida, Akashi (JP); Hiroshi Kanmera, Kako-gun (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/518,310

(22) Filed: Sep. 11, 2006

(65) Prior Publication Data

US 2007/0062500 A1 Mar. 22, 2007

(30) Foreign Application Priority Data

Sep. 13, 2005 (JP) ..... P2005-265198

(51) Int. Cl.
*F01M 13/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,656,991 A * 4/1987 Fukuo et al. ..... 123/572
4,856,486 A * 8/1989 Mori et al. ..... 123/572
6,029,638 A * 2/2000 Funai et al. ..... 123/572
6,073,603 A * 6/2000 Sumi et al. ..... 123/195 AC
6,142,129 A * 11/2000 Hori et al. ..... 123/572
6,334,438 B1 * 1/2002 Itoh et al. ..... 123/572
6,425,451 B2 * 7/2002 Yoshida et al. ..... 180/219
6,508,238 B2 * 1/2003 Furuya ..... 123/572
6,899,091 B2 * 5/2005 Akiyama et al. ..... 123/572
7,163,006 B2 * 1/2007 Sharman ..... 123/572
2005/0205072 A1 * 9/2005 Sharman ..... 123/573

FOREIGN PATENT DOCUMENTS

JP 8-218842 8/1996

* cited by examiner

*Primary Examiner*—M. McMahon
(74) *Attorney, Agent, or Firm*—Wenderoth, Lind & Ponack, L.L.P.

(57) ABSTRACT

A breather structure of an engine having a crank case and a cylinder fastened to an upper side of the crank case can improve the strength of a cylinder and can prevent an increase of weight of the engine. The breather structure is provided with a breather chamber integrally formed with the cylinder in an outer peripheral wall of the cylinder, and the breather chamber separates air including an oil mist within the crank case into an oil component and a gas component, returns the oil component into an oil reservoir of the engine, and discharges the gas component out of the crank case.

13 Claims, 9 Drawing Sheets

BREATHER STRUCTURE OF ENGINE

BACKGROUND OF THE INVENTION

1. Field of the Invention

The present invention relates to a breather structure of an engine, and more particularly to a breather chamber separating an air including an oil mist within the crank case into oil and gas.

2. Prior Art

In general, a breather chamber of the engine is formed in an upper wall portion of the crank case away from the cylinder. Particularly, in an engine provided with a transmission chamber in a rear portion of the crank case, as described in Japanese Unexamined Patent Publication No. 8-218842, the structure is made such that the breather chamber for separating oil mist from the blow-by gas is formed in an upper wall of the transmission chamber in the rear portion of the crank case, the oil component after being separated in the breather chamber is returned to a bottom portion of the transmission chamber or an oil pan.

In an engine mounted to a vehicle such as a motor cycle or the like, in order to respond to a high power requirement in recent years, a cylinder is improved by making a bore diameter large and making a thickness of the cylinder large, or forming a reinforcing rib, thereby reinforcing the cylinder, however, in the case that the thickness is increased or the reinforcing rib is independently formed, a size of the engine is increased and a weight thereof is increased.

Further, in the structure in which the oil component separated in the breather chamber is returned to an oil reservoir via an oil return oil path, in the case that an oil level of the oil reservoir is high, the oil in the oil reservoir flows back through the oil return oil path so as to be pushed back to the breather chamber, on the basis of an oil level fluctuation of the oil reservoir at a time of a rapid acceleration or a rapid deceleration, for example, a back and forth movement of the oil, or a ruffling phenomenon generated by the air pushed down by a vertical motion of the piston pushing the oil within the oil reservoir, so that there is a risk that a breather function is affected.

SUMMARY OF THE INVENTION

The present invention is made by taking the problem mentioned above into consideration, and there is provided a breather structure of an engine having a crank case and a cylinder fastened to an upper side of the crank case, comprising a breather chamber integrally formed with the cylinder in an outer peripheral wall of the cylinder, and the breather chamber separates an air including an oil mist within the crank case into oil component and gas component, returns the oil component after being separated to an oil reservoir of the engine, and discharges the gas component out of the crank case.

In accordance with the structure mentioned above, a peripheral wall of the breather chamber serves as a reinforcing member of the cylinder, can improve a rigidity of the cylinder, can improve a strength of the cylinder, and can respond to a high power requirement while maintaining a light weight and a compactness of the engine.

In the present invention, it is preferable that the breather chamber may be integrally formed with the cylinder and the crank case in such a manner as to come over the upper surface of the crank case from the outer peripheral wall of the cylinder.

In accordance with the structure, the peripheral wall of the breather chamber serves as a reinforcing member coupling the cylinder and the crank case, can effectively increase a rigidity of the cylinder and the crank case, and can improve a strength thereof.

In the present invention, it is preferable that a rotating member accommodating chamber may be integrally formed with the cylinder together with the breather chamber, in the outer peripheral wall of the cylinder.

In accordance with the structure, it is possible to effectively improve the strength of the cylinder.

In the present invention, it is preferable that the rotating member accommodating chamber may be integrally formed with the cylinder and the crank case in such a manner as to come over the upper surface of the crank case from the outer peripheral wall of the cylinder.

In accordance with the structure, the peripheral wall of the rotating member accommodating chamber serves as the reinforcing member coupling the cylinder and the crank case, together with the peripheral wall of the breather chamber, can further increase the rigidity of the cylinder and the crank case, and can improve the strength thereof.

In the present invention, it is preferable that upper surfaces of the breather chamber and the rotating member accommodating chamber may be open, upper surface openings of the breather chamber and the rotating member accommodating chamber may be closed by a common lid to both the chambers.

In accordance with the structure, in the case of integrally casting the cylinder and the crank case, the opening directions of the breather chamber and the rotating member accommodating chamber come to a vertical direction which is approximately equal to a die drawing direction (a vertical direction) of a casting mold for forming the crank case. Accordingly, the openings of the breather chamber and the rotating member accommodating chamber can be simultaneously formed by the casting mold for the crank case, and even if a die drawing direction of a core for forming the breather chamber and the rotating member accommodating chamber is a lateral direction, it is possible to easily assemble the core within the casting mold by utilizing the opening, and a casting work can be easily executed. Further, since the common lid to both the chambers is attached over the openings of both the chambers, it is possible to improve the rigidity of both the chambers.

In the present invention, it is preferable that the breather structure may be provided with an oil return passage returning the oil component separated in the breather chamber to the oil reservoir in the bottom portion of the engine from the breather chamber, and an upper side of the oil reservoir in the bottom portion of the engine may be covered by an oil level fluctuation preventing plate.

In accordance with the structure, it is possible to prevent an oil ruffling phenomenon generated by the air being pushed down on the basis of the vertical motion of the piston, by the oil level fluctuation preventing plate, and it is possible to prevent an air biting by the oil pump. Further, it is possible to prevent a back flow of the oil to the breather chamber from the oil reservoir and it is possible to maintain improved oil pump function and breather function. Particularly, in the case that the engine in accordance with the present invention is mounted to a motor cycle or the like, it is possible to prevent the movement of the oil in the oil reservoir at a time of a rapid acceleration or a rapid deceleration.

In the present invention, it is preferable that the air including oil mist in the crank case may be introduced into the breather chamber through the rotary member accommodating chamber and a breather passage formed between the rotary member accommodating chamber and the breather chamber.

In accordance with the structure, it is possible to make the breather passage compact.

In the present invention, it is preferable that the rotary member accommodating chamber may be a balancer chamber for accommodating a balancer of the engine.

BRIEF DESCRIPTION OF THE DRAWINGS

The above and other objects, features and advantages of the present invention will be become more apparent from the following description taken in connection with the accompanying drawings.

DETAILED DESCRIPTION OF THE PREFERRED EMBODIMENTS

Embodiment

Attached FIGS. 1 to 10 show an example obtained by applying the present invention to an inline 4-cylinder engine for a motor cycle, and a description will be given of an embodiment in accordance with the present invention on the basis of these drawings.

[Outline of Engine]

Figure 1:
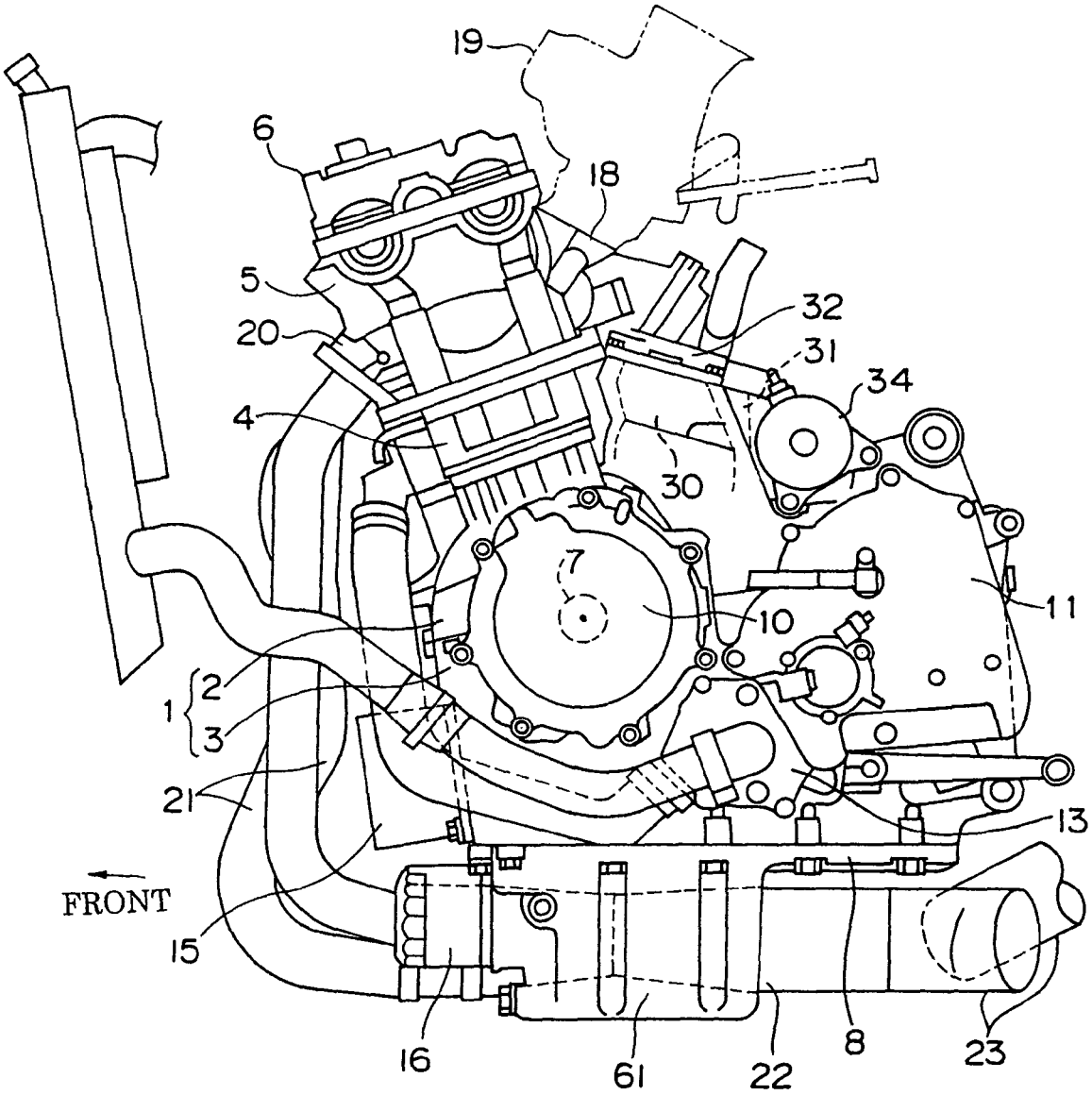
FIG. 1 is a left side elevational view of an embodiment of a 4-cylinder engine for a motor cycle to which the present invention is applied.

FIG. 1 is a left side elevational view of the engine mentioned above, and the following description will be given by setting a direction of an axial length of a crank shaft 7 to a lateral (right and left) direction, and setting a cylinder arranged side in a horizontal direction orthogonal to the axial length direction of the crank shaft 7 to a front side, for convenience of explanation.

In FIG. 1, an outer shell of an engine is mainly constituted by a crank case 1 having a vertically divided two-piece structure comprising an upper crank case member 2 and a lower crank case member 3, a cylinder (a cylinder block) 4 integrally formed with the upper crank case member 2 in an upper surface of a front end portion of the upper crank case member 2, a cylinder head 5 fastened to an upper surface of the cylinder 4, a cylinder head cover 6 fastened to an upper surface of the cylinder head 5, and an oil pan 8 fastened to a lower surface of the lower crank case member 3. A generator cover 10, an output chain cover (an output sprocket cover) 11 and the like are attached to a left end portion of the crank case 1, a water pump 13 is provided in a backward lower side of the generator cover 10, an oil cooler 15 is attached to a front end surface of the lower crank case member 3 so as to protrude forward, and a secondary oil filter 16 is attached to a front end surface of the oil pan 8 so as to protrude forward.

Intake passage inlets 18 which open toward a backward upper side are formed in a rear surface of the cylinder head 5 per cylinders, and a throttle body 19 is connected to each of the intake passage inlets 18. Exhaust passage outlets 20 which open forward are formed per cylinders, and an exhaust pipe 21 is connected to each of the exhaust passage outlets 20.

Figure 2:
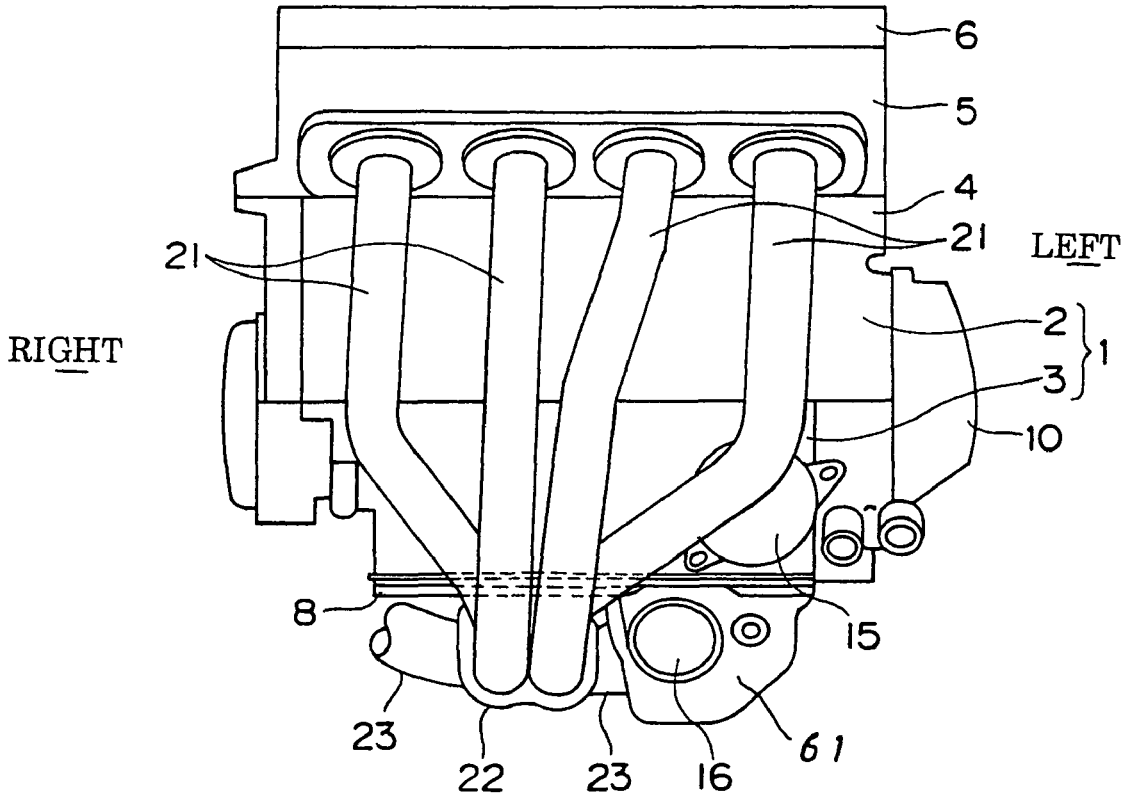
FIG. 2 is a front elevational view of the engine shown in FIG. 1.

FIG. 2 is a front elevational view of the engine shown in FIG. 1. The exhaust pipes 21 extend downward in a front side of the engine, are collected at one position as well as being curved backward in a front lower end portion of the engine, and are connected to one thick catalyst pipe 22 in a lower side of the engine. Further, two right and left exhaust pipes 23 are connected to a rear end portion of the catalyst pipe 22, and these two exhaust pipes 23 respectively extend to both right and left sides of a rear wheel (not shown) and are respectively connected to an exhaust muffler (not shown).

Figure 3:
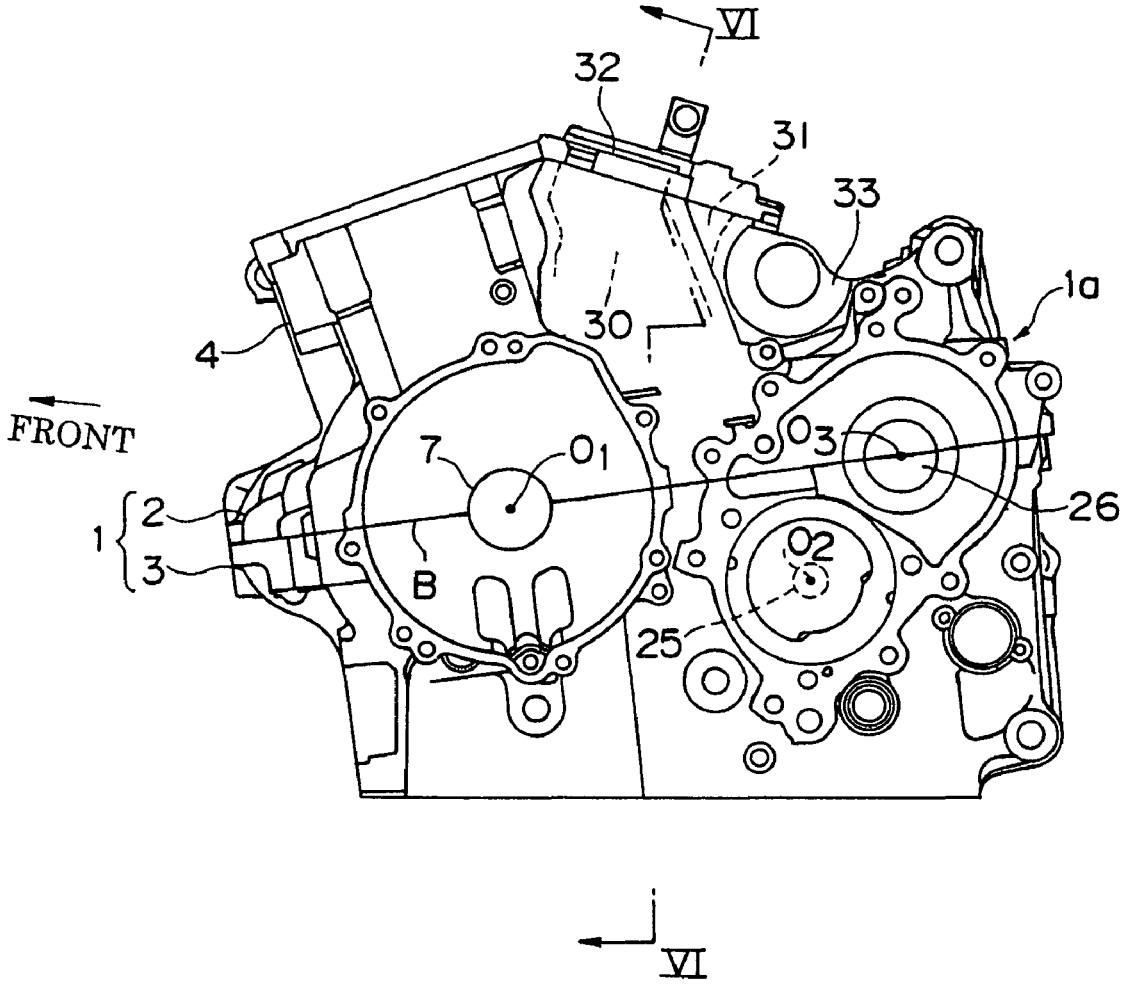
FIG. 3 is a left side elevational view of a cylinder and a crank case of the engine shown in FIG. 1.

FIG. 3 is a left side elevational view of the cylinder 4 and the crank case 1, a transmission case 1*a* is integrally formed in a rear portion of the crank case 1, and respective shafts for changing gears such as an input shaft 25, an output shaft 26 and the like are accommodated within the transmission case 1*a*. The upper crank case member 2 and the lower crank case member 3 are divided into upper and lower pieces by a split surface (a mating surface) B passing through an axis O1 of the crank shaft 7 and an axis O3 of the output shaft 26, and the crank case member 2 is formed in an approximately L shape in a side view so as to be integral with the cylinder 4 in the front end portion as mentioned above. Further, the input shaft 25 is arranged in such a manner that an axis O2 thereof is positioned in a lower side than the split surface B.

[Breather Chamber and Balancer Chamber]

In FIG. 3, a breather chamber 30 and a balancer chamber 31, in which a balancer (not shown) of the engine is accommodated corresponding to one example of the rotating member accommodating chamber are integrally formed with the cylinder 4 and the upper crank case member 2 in such a manner as to come over the upper surface of the upper crank case member 2, from a back surface of an outer peripheral wall of the cylinder 4, respective upper ends of both the chambers 30 and 31 are open, and both the openings of the chambers 30 and 31 are closed by a common lid 32 having a lid portion 32*a* for the breather chamber 30 and a lid portion 32*b* for the balancer chamber 31. A starter motor mounting portion 33 is integrally formed with the balancer chamber 31 in a rear side of the balancer chamber 31, and a starter motor 34 is attached to the starter motor mounting portion 33 as shown in FIG. 1.

Figure 4:
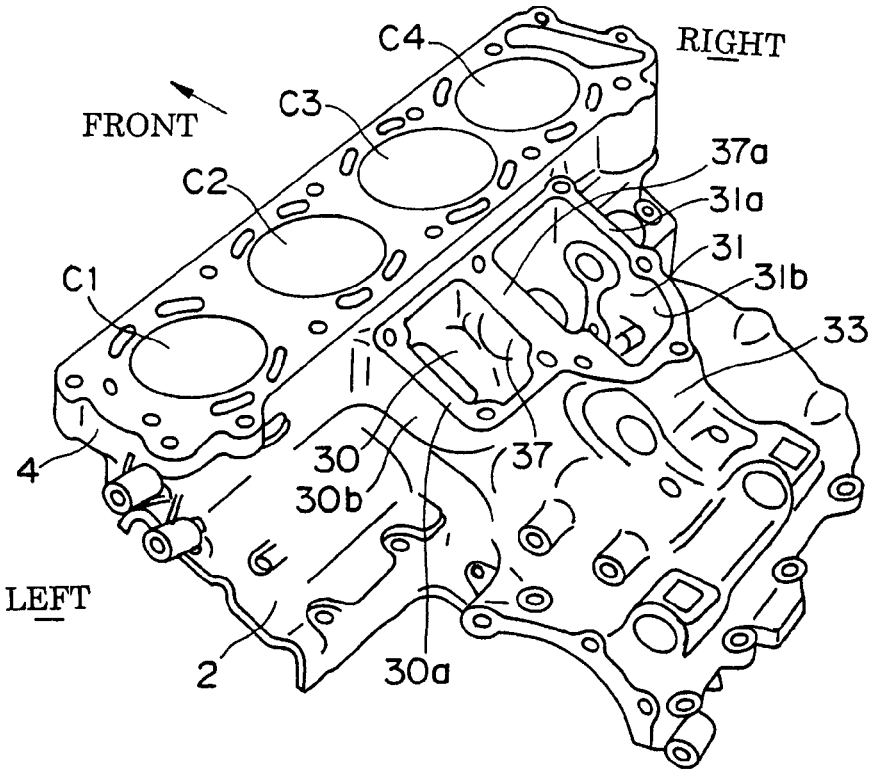
FIG. 4 is a perspective view of an integrally formed product of the cylinder, an upper crank case member, a breather chamber and a balancer chamber of the engine in FIG. 1 as seen from the above in a backward left side.

FIG. 4 is a perspective view of an integrally formed product of the cylinder 4, the upper crank case member 2, the breather chamber 30 and the balancer chamber 31 as seen from the above in a backward left side. In this FIG. 4, the engine is provided with first, second, third and fourth cylinders C1, C2, C3 and C4 in this order from the left side, the breather chamber 30 is positioned approximately at a back surface of the second cylinder C2, and the balancer chamber 31 is formed in a right side of the breather chamber 30 via a partition wall 37 and is positioned approximately at a back surface of the third cylinder C3. Lid mounting surfaces 30*a*, 31*a* and 37*a* formed in upper ends of peripheral walls 30*b* and 31*b* of both the chambers 30 and 31 and the partition wall 37 are inclined in a backward downward direction in such a manner as to surround the openings of both the chambers 30 and 31, whereby the peripheral walls 30*b* and 31*b* of the breather chamber 30 and the balancer chamber 31 and the partition wall 37 serve as a reinforcing rib connecting the back surface of the cylinder 4 and the upper surface of the upper crank case member 2 in an approximately triangular shape in a side view. In this case, a common lid mounting surface 37*a* formed in an upper surface of the partition wall 37 is formed so as to be wider than the other lid mounting surfaces 30*a* and 31*a*.

Figure 5:
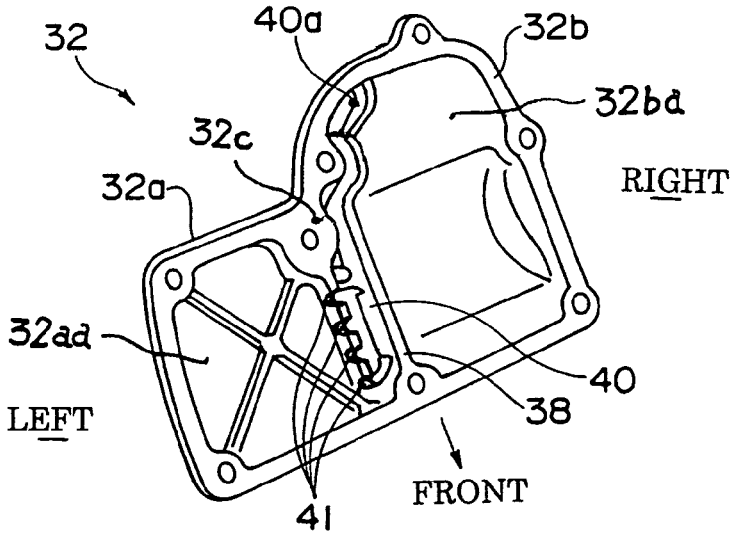
FIG. 5 is a perspective view of a common lid to the breather chamber and the balancer chamber as seen from the below in the backward left side.

FIG. 5 is a perspective view of the common lid 32 as seen from below in the forward left side. A groove-shaped breather passage 40 extending from a left rear end portion 40*a* of the lid portion 32*b* for the balancer chamber 30 to a front end of a partition wall 38 formed between both the lid portions 32*a* and 32*b* is formed in a back surface 32*c* of the common lid 32, and a plurality of communication holes (notches) 41 communicating the groove-shaped breather passage 40 and an inner side 32*aa* of the breather chamber lid portion 32*a* are formed in the partition wall 38, whereby it is possible to circulate the air including the oil mist from an inner side 32*ba* of the balancer chamber lid portion 32*b* to the inner side 32*aa* of the breather chamber lid portion 32*a*. The groove-shaped breather passage 40 and the communication hole 41 are completed as a tunnel-shaped passage by being lapped over the upper end lid mounting surface 37*a* of the partition wall 37 between both the chambers 30 and 31 in FIG. 4. In a state in which the common lid 32 is attached on the balancer chamber 31, the rear end portion 40*a* of the breather passage 40 is communicated with the inner side 32*ba* of the balancer chamber lid portion 32*b*.

Figure 6:
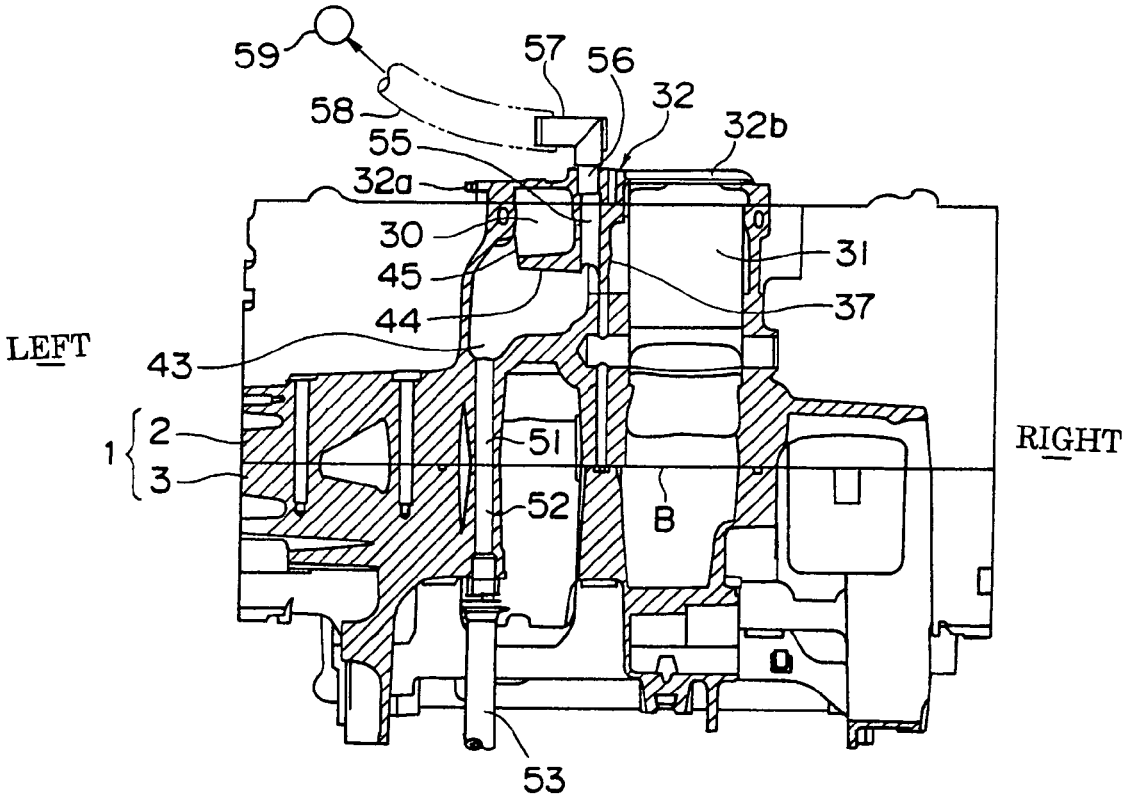
FIG. 6 is an enlarged view of a cross section along a line VI-VI in FIG. 3.

FIG. 6 is an enlarged view of a cross section along a line VI-VI in FIG. 3. An oil gas separating wall 44 is formed in the breather chamber 30 at a position spaced at a predetermined distance from the breather chamber lid portion 32*a* to a lower side, a lower breather chamber 43 is formed in a lower side of the oil gas separating wall 44, and the upper and lower breather chambers 30 and 43 are communicated with a gap 45 formed in a left end of the oil gas separating wall 44. An oil return passage 51 extending from a bottom surface of the lower breather chamber 43 to a lower side is formed within the upper crank case member 2, the oil return passage 51 is communicated with an oil return passage 52 formed in the lower crank case member 3, the oil return passage 52 extends to a lower side, and an oil return hose 53 is connected to a lower end opening portion of the oil return passage 52. On the other hand, an air vent passage 55 extending to an upper side while communicating with the lower breather chamber 43 is formed within the partition wall 37 between both the chambers 30 and 31, an upper end opening of the air vent passage 55 is communicated with an air vent passage 56 formed within the common lid 32, an air vent hose 58 is connected to the air vent passage 56 via an L-shaped joint pipe 57, and the air vent hose 58 is connected to an air cleaner 59.

[Oil Pan and Oil Path]

Figure 8:
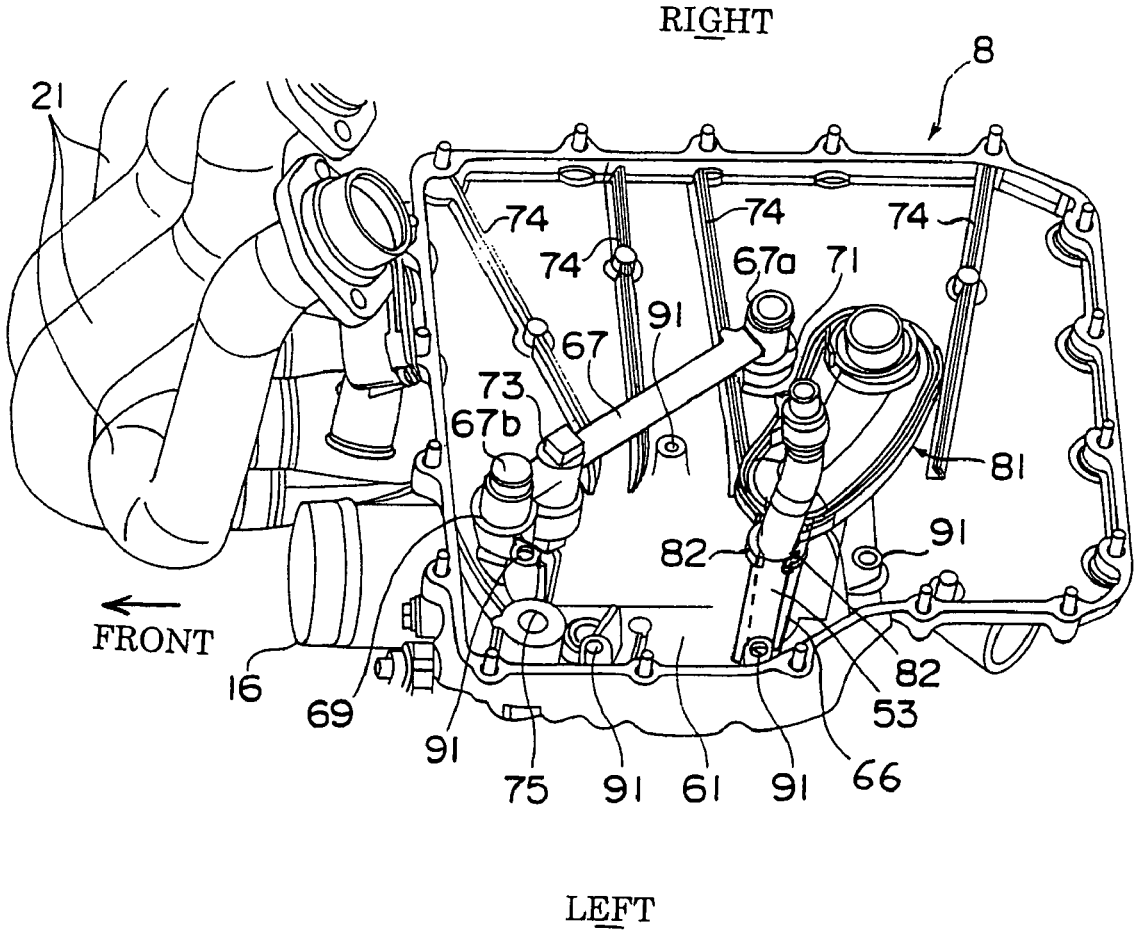
FIG. 8 is a perspective view of the oil pan of the engine shown in FIG. 1 from the above in a forward left side.
Figure 9:
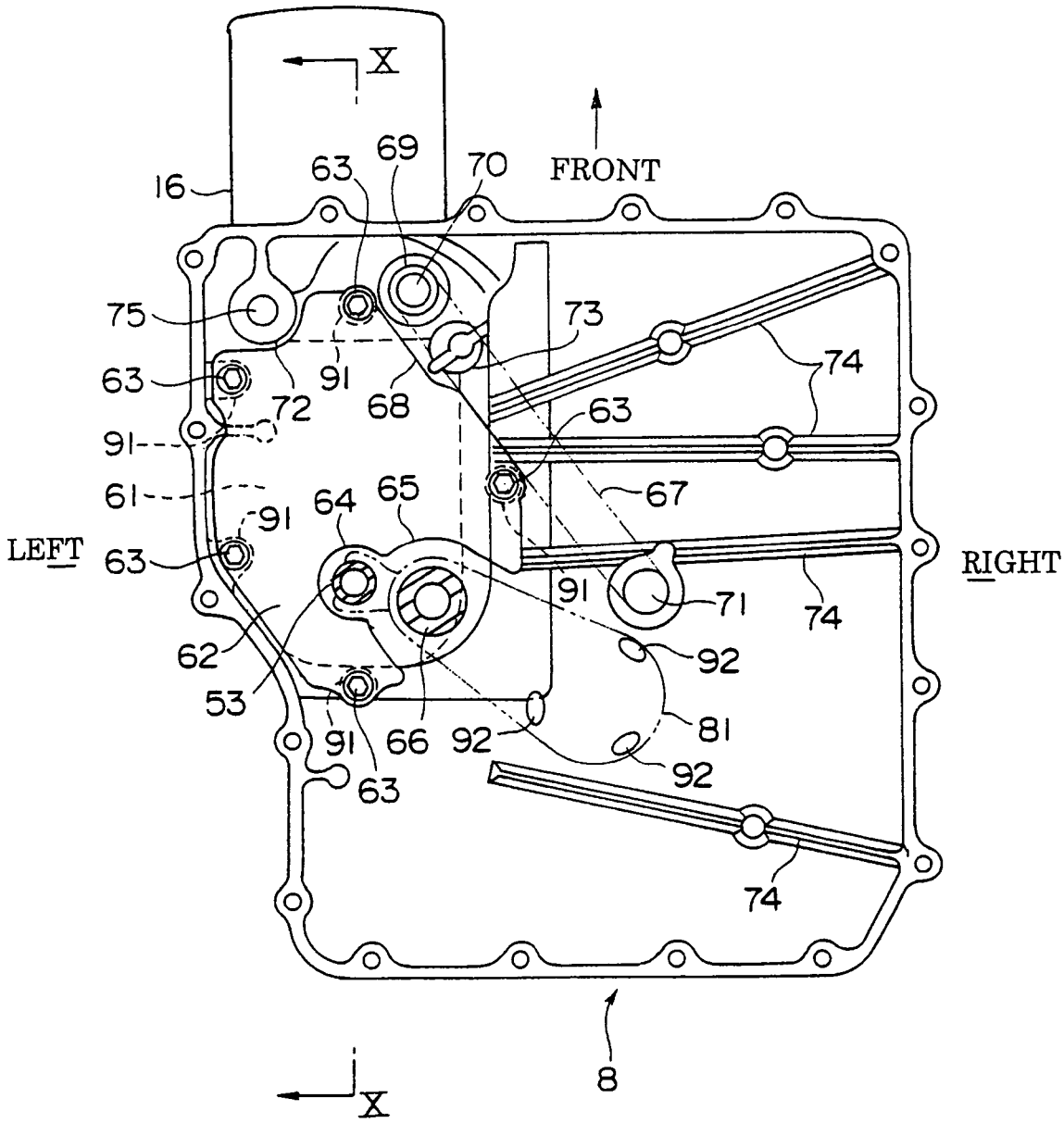
FIG. 9 is a plan view of the oil pan of the engine shown in FIG. 1.

FIG. 9 is a plan view of the oil pan 8. The oil pan 8 is formed approximately in a rectangular shape in a plan view, and a left end portion in a front half portion protrudes leftward a little. About a left half or less region (a region having about a quarter or a fifth part of an entire area of the oil pan) is formed as a concave portion 61 having a deep bottom in a front half portion of the oil pan 8, and the remaining region is formed as a flat shape having a shallow bottom (see FIG. 8).

In a bottom surface of the oil pan 8, an oil passage 75 and an oil passage 70 are formed within an upwardly protruding tubular wall and are open upward, in left and right end portions of a front end portion of the concave portion 61. The oil passage 75 is communicated with a filtered side space portion of a secondary oil filter 16, and the oil passage 70 is communicated with an unfiltered side space portion of the secondary oil filter 16. A fitting concave portion 69 for connecting an oil passage pipe 67 is formed coaxially with the oil passage 70 in an upper end portion of the latter oil passage 70, a fitting concave portion 71 for connecting the oil passage pipe 67 is formed at a position spaced at a predetermined distance to a right rear side from the fitting concave portion 69 (near an approximately center position of the oil pan 8), and the fitting concave portion 71 is also formed within the upward protruding tubular wall.

A plurality of guide ribs 74 are formed in the flat portion having the shallow bottom in the oil pan 8 for guiding the oil within the oil pan 8 into the concave portion 61, and a plurality of (three) support projections 92 is formed for supporting a primary oil filter 81 mentioned below in a contact manner from below.

A plurality of boss portions 91 for attaching the oil level fluctuation preventing plate 62 are formed at an interval around the concave portion 61 so as to protrude upward, and the flat oil level fluctuation preventing plate 62 covering an upper side of the concave portion 61 is mounted on the boss portion 91, and is fixed to the oil pan 8 by a plurality of bolts 63.

A notch 64 and a notch 65 are formed as a potbellied shape in a plan view in a rear end portion of the oil level fluctuation preventing plate 62, and a notch 68 is formed in a right end portion in a front side of the oil level fluctuation preventing plate 62. The notch 64 is provided for inserting the oil return hose 53 therethrough, the notch 65 is provided for inserting an insertion pipe 66 formed in the primary oil filter 81 therethrough, and the notch 68 is provided for arranging the oil passage pipe 67.

Figure 10:
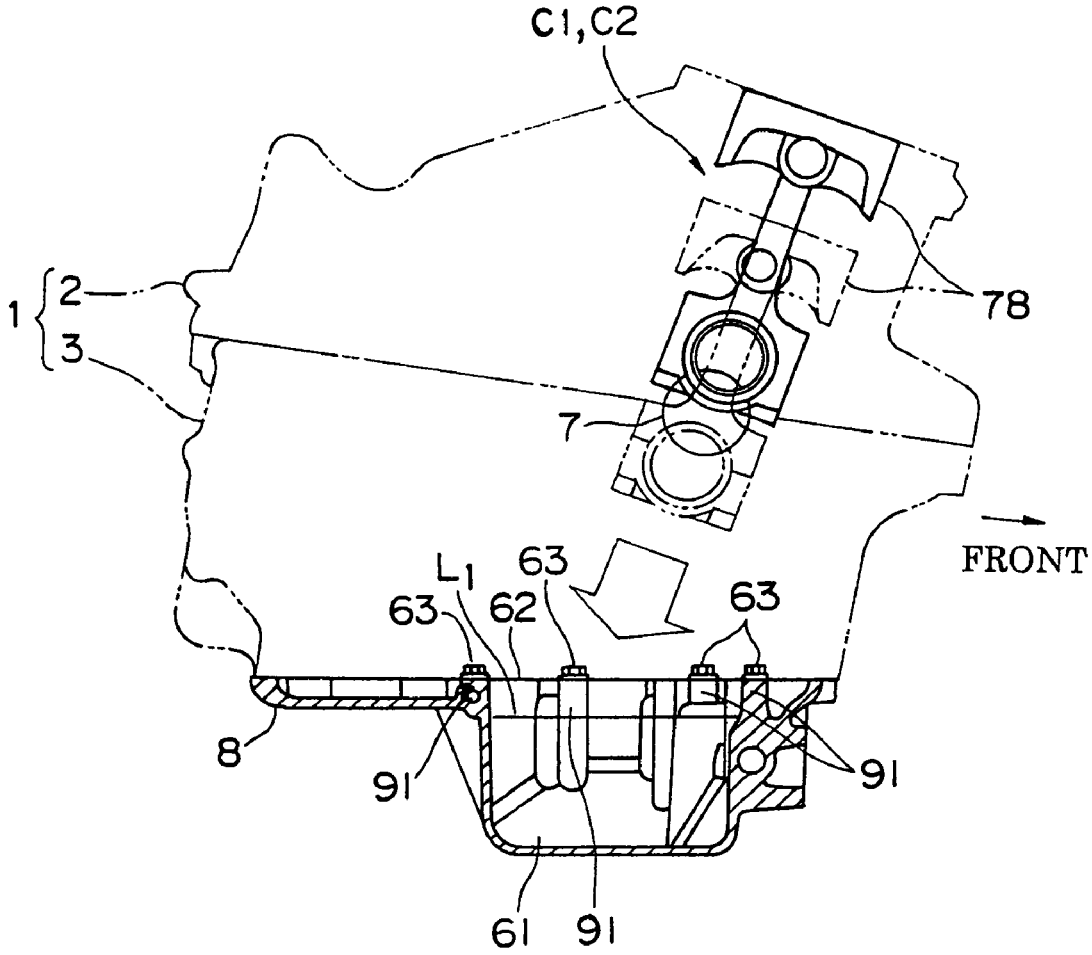
FIG. 10 is a cross section along a line X-X in FIG. 9.

FIG. 10 is a cross sectional view along a line X-X in FIG. 9. The concave portion 61 of the oil pan 8 is positioned approximately in a lower side of the pistons 78 for the first and second cylinders C1 and C2, and the air in the lower side of the pistons 78 are pushed down toward the concave portion 61 side as shown by an outline arrow, on the basis of a vertical motion of the pistons 78 of the first and second cylinders C1 and C2.

In FIG. 2, as mentioned above, the concave portion 61 of the oil pan 8 is formed approximately in a left half of the oil pan 8, and the catalyst pipe 22 is arranged in a space portion formed by the right side surface of the concave portion 61 and the lower surface of the flat portion having the shallow bottom in the oil pan 8.

FIG. 8 is a perspective view of the oil pan 8 as seen from above in the forward left side. The primary oil filter 81 is arranged so as to extend to a right backward direction from the upper position of the rear end portion of the concave portion 61, and a lower end portion of the oil return hose 53 is arranged next to the primary oil filter 81 in the left, and the oil return hose 53 is retained by a pair of circular arc shaped clamps 82 integrally formed in a left end of the primary oil filter 81, and is opened toward the inner side of the concave portion 61.

A tubular oil outlet portion 67*b* open to a lower side is formed in a front end of the oil passage pipe 67, the oil outlet portion 67*b* is fitted to the fitting concave portion 69 of the oil pan 8, a tubular oil inlet portion 67*a* open to an upper side is formed in a rear end portion of the oil passage pipe 67, and the oil inlet portion 67*a* is fitted to the fitting concave portion 71 of the oil pan 8. A relief valve 73 facing to the lower side concave portion 61 is provided in the middle of the oil passage pipe 67.

Figure 7:
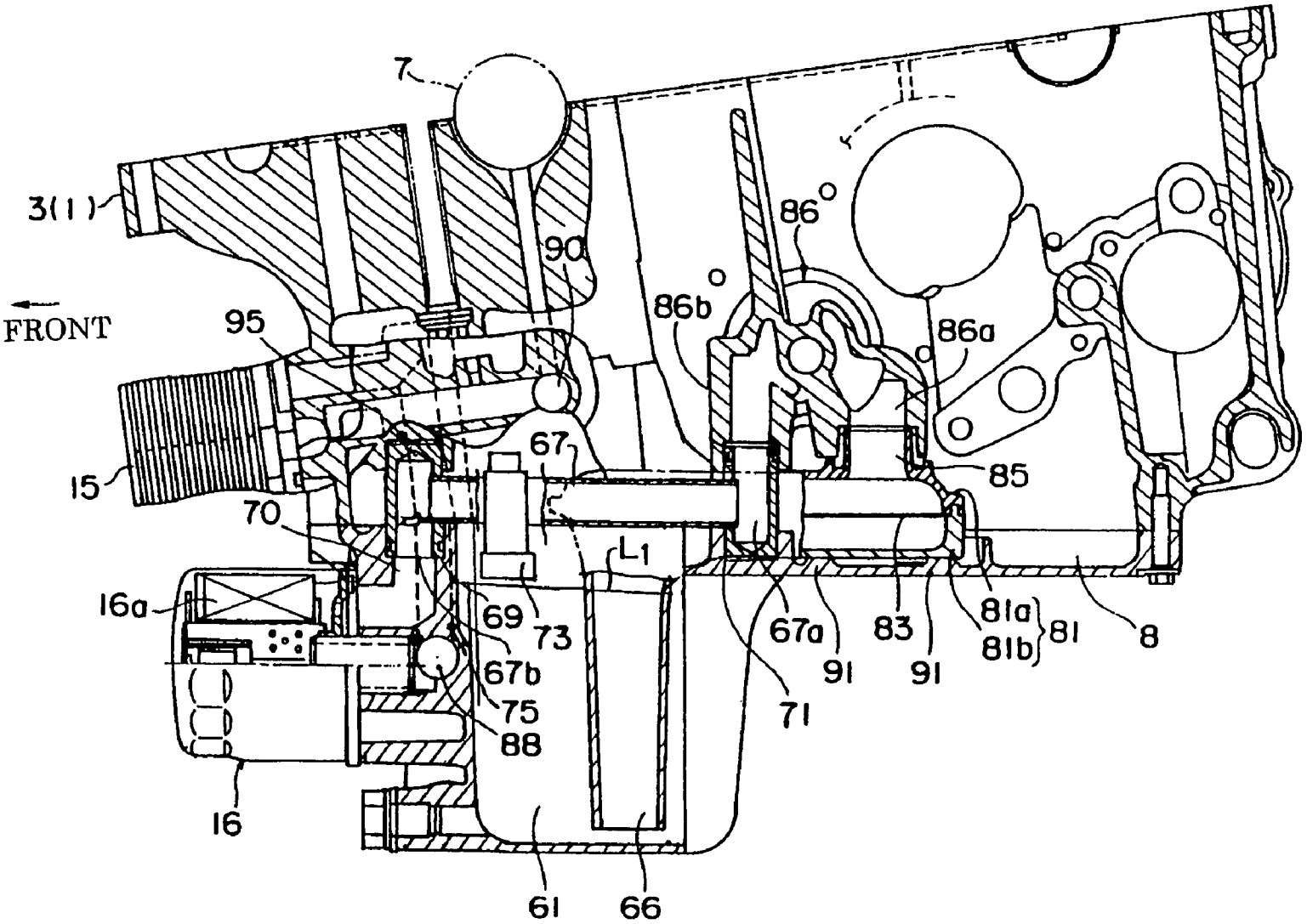
FIG. 7 is a vertical cross sectional side elevational view of a lower crank case member and an oil pan of the engine shown in FIG. 1.

FIG. 7 is a vertical cross sectional side elevational view of the lower crank case member 3 and the oil pan 8. The oil passage pipe 67 is structured such that the oil outlet portion 67*b* is pinched between a fitting concave portion 95 formed in the lower crank case member 3 and the fitting concave portion 69 of the oil pan 8 from the above and the below, and the rear end oil inlet portion 67*a* is pinched between the discharge port 86*b* of the oil pump 86 and the fitting concave portion 71 of the oil pan 8 from the above and the below, by assembling the oil pan 8 in the lower surface of the lower crank case member 3 as shown in FIG. 7.

An outer shell of the primary oil filter 81 is structured as a vertically divided two-piece structure, and a net plate shaped filter element 83 is pinched between upper and lower case members 81*a* and 81*b*. The suction pipe 66 integrally formed in a front end portion of the primary oil filter 81 extends to a lower side within the concave portion 61, and is open near a bottom surface of the concave portion 61. An upper end oil outlet 85 of the primary oil filter 81 is connected to a suction port 86*a* of the oil pump 86 provided within the lower crank case member 3. The primary oil filter 81 is pinched between the oil suction port 86*a* of the oil pump 86 and the support projection 91 of the oil pan 8 from the above and the below by assembling the oil pan 8 in the lower surface of the lower crank case member 3.

The discharge port 86*b* of the oil pump 86 is open to a lower side, and is connected to the rear end oil inlet portion 67*a* of the oil passage pipe 67 as mentioned above. The oil outlet portion 67*b* of the oil passage pipe 67 is communicated with the unfiltered side space portion of the secondary oil filter 16 via the oil passage 70 mentioned above. The filtered side space portion in the inner portion of the annular element 16*a* arranged within the secondary oil filter 16 is communicated with an inlet of the oil cooler 15 via a sideways oil passage 88 within the oil pan 8 and the oil passage 75 (FIG. 8), and an oil outlet of the oil cooler 15 is communicated with a main gallery 90.

[Oil Circulation During Engine Operation]

In FIG. 7, during the engine operation, the oil (for example, the oil level L1) within the concave portion 61 of the oil pan 8 passes through the inner side of the suction pipe 66 and the primary oil filter 81, and is sucked into the oil pump 86 from the suction port 86*a*, and the oil pressurized by the oil pump 86 comes into the second oil filter 16 from the oil discharger port 86*b* through the oil passage pipe 67 and the oil passage 70, and is filtered by the element 16*a*. The filtered oil comes into the oil cooler 15 through the oil passage 88 or the like, and is pressure fed to each of the lubricating positions such as the bearing portion of the crank shaft 7 and the like from the main gallery 90 after being cooled. Further, the oil after lubricating each of the lubricating positions is returned to the oil pan 8.

[Operation and Effect of Embodiment]

(1) In FIG. 10, during the engine operation, a pressure fluctuation is generated within the crank case 1 on the basis of the vertical motion of the pistons 78, and the air in the lower space of the piston 78 is pushed down.

The air pushed down by the piston 78 for the first and second cylinders C1 and C2 positioned in the upper side of the concave portion 61 moves toward the inner side of the concave portion 61, however, is shielded by the oil level fluctuation preventing plate 62 arranged in the upper side of the concave portion 61. Accordingly, the pushed-down air does not act on the oil within the concave portion 61, and the oil within the concave portion 61 is not ruffled. In other words, since the oil ruffling phenomenon is not generated, it is possible to prevent the oil within the oil return hose 53 in FIG. 7 from flowing back due to the pushed-down air, and there is no risk that it affects the breather operation in the breather chamber 30 in FIG. 6.

(2) In FIG. 7, if the vehicle is rapidly accelerated during the engine operation, the oil within the concave portion 61 is moved backward, however, since the oil level fluctuation preventing plate 62 is arranged in the upper side of the concave portion 61 as mentioned above, an amount of the oil overflowing to the rear side from the concave portion 61 is small, and the oil level L1 within the concave portion 61 is not widely lowered. Further, since the oil suction pipe 66 is arranged near the rear end portion of the concave portion 61 and is open near the bottom surface of the concave portion 61, there is no fear that the air biting is generated in the oil suction operation by the oil pump 86. On the other hand, if the vehicle is rapidly decelerated, the oil within the concave portion 61 is moved to the front side, however, since the oil level fluctuation preventing plate 62 is arranged in the upper side of the concave portion 61, and the front end of the concave portion 61 forms the front end of the oil pan 8 itself, the oil hardly leaks from the concave portion 61. In this case, there is no fear that the air biting is generated in the oil suction operation by the oil pump 86.

(3) In FIG. 6, the pressure fluctuation is generated within the crank case 1 as mentioned above during the operation, however, when the pressure is increased, the air including the oil mist within the crank case 1 flows into the breather chamber 30 through the breather passage 40 and the communication hole 41 within the common lid 32 in FIG. 5 from the inner side of the balancer chamber 31, and comes into collision with the oil gas separating wall 44 and the inner peripheral surface of the breather chamber 30. Accordingly, the air is separated into the oil component and the gas component, and the gas component after being separated is sucked into the air cleaner 59 through the air vent passage 55 within the partition wall 37, the air vent passage 56 within the partition wall 38 of the common lid 32, the joint pipe 57 and the air vent hose 58. On the other hand, the oil component separated within the breather chamber 30 is directly returned to the concave portion 61 of the oil pan 8 in FIG. 7 through the lower side oil return passages 51 and 52 and the oil return hose 53.

(4) In the present embodiment, as shown in FIG. 3, since the breather chamber 30 and the balancer chamber 31 are integrally formed with the cylinder 4 and the upper crank case member 2 from the back surface of the cylinder 4 over the upper surface of the upper crank case member 2, in the structure in which the cylinder 4 and the upper crank case member 2 are integrally formed in the L shape, the peripheral walls 30*b* and 31*b* of the breather chamber 30 and the balancer chamber 31 and the partition wall 37 serve as a reinforcing member. Accordingly, it is possible to increase a rigidity of the cylinder 4 and the crank case 1 and improve strength without making the thicknesses of the cylinder 4 and the crank case 1 large in correspondence to the high power requirement of the engine or forming the rib exclusively used for reinforcing as in the conventional structure. In other words, it is possible to improve the rigidity of the cylinder 4 and the crank case 1 in such a manner as to respond to the high power requirement while maintaining the compact structure and the reduced weight of the engine.

(5) In FIG. 4, since the peripheral walls 30*b* and 31*b* of the breather chamber 30 and the balancer chamber 31 and the partition wall 37 are formed such that the upper end lid mounting surfaces 30*a*, 31*a* and 37*a* are inclined in the backward downward direction, the peripheral walls of the breather chamber 30 and the balancer chamber 31 and the partition wall forming a cavity in a casting mold form a molten metal passing way in the case of casting the integral product of the cylinder 4 and the upper crank case member 2. Accordingly, the molten metal smoothly flows from the cavity for forming the cylinder 4 to the cavity for forming the upper crank case member 2, it is possible to easily execute casting work and a yield ratio of the product is improved.

(6) In FIG. 4, since the openings are formed in the upper ends of the breather chamber 30 and the balancer chamber 31, the opening directions come to the vertical direction which is approximately equal to a die drawing direction (a vertical direction) of the casting mold for forming the upper crank case member 2 in the case of integrally casting the cylinder 4 and the upper crank case member 2. Accordingly, the openings of the breather chamber 30 and the balancer chamber 31 can be simultaneously formed by the casting mold for the crank case, and even if a die drawing direction of a core for the breather chamber 30 and the balancer chamber 31 is a lateral direction, it is possible to easily assemble the core within the casting mold by utilizing the opening, and casting work can be easily executed.

(7) In FIG. 3, since the common lid 32 is attached to the open ends of both the chambers 30 and 31, the common lid 32 itself serves as the reinforcing member of the cylinder 4 and the upper crank case member 2, and contributes to an improvement of the rigidity of the cylinder 4 and the upper crank case member 2.

(8) In FIG. 6, since the oil component after being separated into the oil and the gas in the breather chamber 30 is returned to the inner side of the concave portion 61 in FIG. 8 from the oil return passages 51 and 52 formed within the crank case members 2 and 3 by utilizing the oil return hose 53, and the oil return hose 53 is retained by the clamp 82 formed in the primary oil filter 81 arranged in the upper side of the concave portion 61, it is possible to easily structure a part of the oil component return path to the concave portion 61 by the oil return hose 53, and it is possible to prevent the vibration of the oil return hose 53 due to the vibration of the engine and the oscillation of the vehicle.

Other Embodiments (1) In the embodiment mentioned above, the present invention is applied to the engine provided with the crank case having the vertical two-piece divided structure, however, the present invention can be applied to an engine provided with a crank case having a lateral two-piece divided structure.

(2) In the embodiment mentioned above, the breather chamber is formed in the back surface of the outer peripheral wall of the cylinder, however, the breather chamber can be formed near the right and left side surfaces, in the outer peripheral wall of the cylinder.

(3) As the rotating member accommodating chamber provided next to the breather chamber, the balancer chamber accommodating the balancer is formed in the embodiment mentioned above, however, another chamber accommodating the other rotating members, for example, various rotating members such as a gear for transmitting a starting power, an intermediate gear of the transmission and the like can be provided.

(4) The breather chamber can be integrally formed with the cylinder in the back surface of the cylinder, in a state in which the breather chamber is separated from the upper surface of the crank case.

The present invention is not limited to the engine for the motor cycle, but can be utilized in an engine for the other vehicles such as a saddle riding type four-wheeled traveling vehicle or the like.

Although the present invention has been described in its preferred embodiments with a certain degree of particularity, obviously many changes and variations are possible therein. It is therefore to be understood that the present invention may be practical otherwise than as specifically described herein without departing from the scope and spirit thereof.

What is claimed is:

1. A breather structure of an engine having a crank case and a cylinder block, comprising:

a breather chamber configured to separate air including oil mist within the crank case into an oil component and a gas component, to return the oil component to an oil reservoir of the engine, and to discharge the gas component out of the crank case, wherein an upper part of the crank case is integrally formed with a transmission case portion and the cylinder block, and extends from the cylinder block to a rear of the engine in a direction orthogonal to an axial direction of a crankshaft of the engine, wherein the upper part of the crank case and the cylinder block are arranged approximately in an L-shape as viewed in the axial direction of the crankshaft of the engine, and wherein the breather chamber, includes a wall as a reinforcing rib, the wall extending from a rear surface of the cylinder block toward the rear of the engine in the direction orthogonal to the axial direction of the crankshaft, the wall being integrally formed with the cylinder block and an upper external surface of the upper part of the crank case further comprising a rotating member accommodating chamber arranged at a side of the breather chamber in the axial direction of the crank shaft of the engine, wherein the breather chamber and the rotating member accommodating chamber share the wall as a common wall arranged between the breather chamber and the rotating member accommodating chamber, wherein upper surfaces of the breather chamber and the rotating member accommodating chamber include openings, respectively, the openings of the breather chamber and the rotating member accommodating chamber being arranged to be closed by a lid common to both chambers.

2. The breather structure of the engine as claimed in claim 1, further comprising an oil return passage for returning the separated oil component to the oil reservoir in a bottom portion of the engine from the breather chamber, wherein an upper side of the oil reservoir in the bottom portion of the engine is covered by an oil level fluctuation preventing plate.

3. The breather structure of the engine as claimed in claim 1, wherein the air including oil mist in the crank case is introduced into the breather chamber through the rotary member accommodating chamber and a breather passage formed between the rotary member accommodating chamber and the breather chamber.

4. The breather structure of the engine as claimed in claim 1, wherein the rotary member accommodating chamber is a balancer chamber for accommodating a balancer of the engine.

5. The breather structure of the engine as claimed in claim 1, wherein the cylinder block includes four cylinders arranged along the axial direction of the crankshaft, wherein the breather chamber is arranged at a rear surface of a second cylinder of the four cylinders, and wherein the rotary member accommodating chamber is arranged at a rear surface of a third cylinder of the four cylinders.

6. The breather structure of the engine as claimed in claim 1, wherein the cylinder block includes four cylinders arranged along the axial direction of the crankshaft, and wherein the common wall is arranged so as to be substantially centered between second and third cylinders of the four cylinders.

7. The breather structure of the engine as claimed in claim 1, further comprising:

additional walls as reinforcing ribs, each of the additional walls being parallel to the common wall and being integrally formed with the cylinder block and the upper external surface of the upper part of the crank case, wherein the common wall is wider than each of the additional walls in the axial direction of the crankshaft.

8. The breather structure of the engine as claimed in claim 1, further comprising:

an oil gas separating wall arranged so as to partition the breather chamber into an upper breather chamber and a lower breather chamber.

9. The breather structure of the engine as claimed in claim 8, further comprising:

additional walls as reinforcing ribs, each of the additional walls being parallel to the common wall and being integrally formed with the cylinder block and the upper external surface of the upper part of the crank case, wherein the common wall is wider than each of the additional walls in the axial direction of the crankshaft; and an air vent passage formed in the common wall so as to extend upward from the lower breather chamber.

10. The breather structure of the engine as claimed in claim 1, wherein the wall includes a portion which extends from an upper part of the rear surface of the cylinder block toward the rear of the engine.

11. The breather structure of the engine as claimed in claim 1, wherein the wall extends in a direction parallel to a movement direction of a piston within the cylinder block.

12. The breather structure of the engine as claimed in claim 1, wherein the wall connects the rear surface of the cylinder block and the upper external surface of the crank case in a triangular shape as viewed in the axial direction of the crankshaft.

13. The breather structure of the engine as claimed in claim 1, wherein an upper surface of the wall slants downward toward the rear of the engine.

* * * * *